United States Patent [19]

Schiff et al.

[11] Patent Number: 4,805,645

[45] Date of Patent: Feb. 21, 1989

[54] TWO MODE ARTIFICIAL NAIL

[75] Inventors: Jane A. Schiff, Lawrenceville, N.J.; Edward Fishman, Simi Valley, Calif.

[73] Assignee: Jazco International, Inc., Bensalem, Pa.

[21] Appl. No.: 77,906

[22] Filed: Jul. 27, 1987

[51] Int. Cl.[4] ..... A45D 29/00

[52] U.S. Cl. ..... 132/73; 132/285

[58] Field of Search ..... 132/73, 88.5, 88.7, 132/1 R

[56] References Cited

U.S. PATENT DOCUMENTS

| | | | |
|---|---|---|---|
| 2,031,225 | 2/1936 | O'Donnell | 275/82 |
| 2,166,950 | 7/1939 | German et al. | 132/73 |
| 2,239,040 | 4/1941 | Holmes | 132/1 |
| 2,288,386 | 6/1942 | Belden | 132/88.7 |
| 2,746,460 | 5/1956 | Jellinek | 132/73 |
| 2,764,166 | 9/1956 | Bogoslowsky | 132/73 |
| 2,864,384 | 12/1958 | Walter | 132/73 |
| 2,941,535 | 6/1960 | Lappe | 132/73 |
| 2,979,061 | 4/1961 | Greenman et al. | 132/73 |
| 3,245,418 | 4/1966 | Dinerstein | 132/88.5 |
| 3,478,756 | 11/1969 | Sautter et al. | 132/73 |
| 3,485,251 | 12/1969 | Brunet et al. | 132/88.5 |
| 3,982,551 | 9/1976 | Bartolucci | 132/73 |
| 3,993,084 | 11/1976 | Cullen | 132/73 |
| 4,211,246 | 7/1980 | Hokama | 132/76.4 |
| 4,346,720 | 8/1982 | Hokama | 132/73 |
| 4,554,935 | 11/1985 | Hokama | 132/73 |

FOREIGN PATENT DOCUMENTS

| | | | |
|---|---|---|---|
| 167329 | 1/1986 | European Pat. Off. | 132/73 |

*Primary Examiner*—John Weiss

*Attorney, Agent, or Firm*—Richard C. Woodbridge

[57] ABSTRACT

An artificial nail tip includes a snap-off portion that can be removed in order to better attach the nail tip to problem nails. The artificial nail tip has a forward section that normally extends beyond the front edge of the nail plate and a thinner rear section, attached to the front section, which is attachable with adhesive to the nail plate. A series of perforations incorporated in the rear section permits a portion of the rear section to be snapped off. Removal of the removable portion permits the nail tip to be flattened and more efficiently and effectively attached to certain types of problem nails. It allows the remaining portion of the nail plate to be exposed to the air thereby decreasing the possibility of fungus infections such as are common with prior art artificial nail tips.

11 Claims, 5 Drawing Sheets

TWO MODE ARTIFICIAL NAIL

BACKGROUND OF THE INVENTION

1. Field of the Invention

The invention relates to an artificial nail that can be attached to normal nail plates or, by snapping out a portion in the rear section thereof, attached more efficiently and effectively to problem nail plates.

2. Description of Related Art

Artificial nails have been known for a long time. They are used both for cosmetic and prothetic purposes. It is also known that different people have different types of nails. While conventional artificial nail tips may fit well on normal nails, it has been found that they do not fit as well on irregular or problem nails. Problem nails include, but are not limited to, bitten nails, flat nails, claw nails, nails having deep grooves and high ridges, olive pit nails or ski nails as shown respectively in FIGS. 4A–4F. Adhesives do not adequately anchor artificial nail tips to problem nail plates due to air pockets that form between the nail tip and the problem nail plate. Even if properly anchored, it frequently occurs that infection sets in where air pockets are formed. Occasionally a manicurist may cut a portion of a nail tip out in order to contour it to a problem nail tip. However, cutting a nail is a difficult procedure and frequently results in ruined nail tips or improver fitting tips.

The concept of providing perforations in the base of a nail tip for the purpose of snapping out an appropriately sized section does not appear to be described or suggested as such in the art. Nevertheless, holes are occasionally found in the rear section of a nail tip for other purposes. See, for example, U.S. Pat. Nos. 2,941,535 and 4,554,935 which describe artificial nail tips having apertures therein for the purpose of permitting excess quantities of adhesive materials to pass through those apertures and to spread to the top side of the artificial nail.

The concept of providing perforations in a fingernail wrapper, typically a flexible sheet of paper, is discussed in another context in U.S. Pat. No. 3,993,084. Perforations are occasionally employed for other cosmetic articles such as eye liner guides as described in U.S. Pat. No. 3,485,251. Also, printed indicia having the appearance but not structure or form of perforations are occasionally found on nail polishing masks as described in U.S. Pat. No. 2,239,040.

Other patents of possible interest and relevance to the present invention include the following: 2,764,166; 2,864,384; 3,478,756; 3,982,551; 4,211,246 and 4,346,720.

Insofar as understood none of the prior art teaches or suggests an artificial nail tip having snap-off perforations so that the nail tip has the option of being used in one of two modes.

SUMMARY OF THE INVENTION

Briefly described the invention comprises an artificial nail tip which includes a snap-off portion in the rear section thereof. The artificial nail tip includes a thick forward section that normally extends beyond the front edge of the human nail plate and a thinner rear section, attached to the front section, which is normally attachable with adhesive to the nail plate. According to the present invention a series of perforations are incorporated in the rear section so that a portion of the rear section can be snapped off and removed. Removal of the removable portion of the rear section permits the nail tip to be flattened and therefore more efficiently and effectively attached to certain common types of problem nail plates. When the detachable portion is removed it leaves behind a remainder that is thin in the center and relatively wide on the sides. The side portions provide sufficient land to permit adequate adhesive anchoring. The thinner center section permits the nail to flex readily so that it can be flattened out to fit the contour of the problem nail plate. The removal of the detachable section not only permits the nail tip to be flattned but also allows the remaining portion of the nail plate to be exposed to the air thereby decreasing the possibility of fungus infection.

These and other features of the present invention will be more fully understood by reference to the following drawings:

DETAILED DESCRIPTION OF THE INVENTION

During the course of this description like numbers will be used to identify like elements according to the different views which illustrate the invention.

Figure 1:
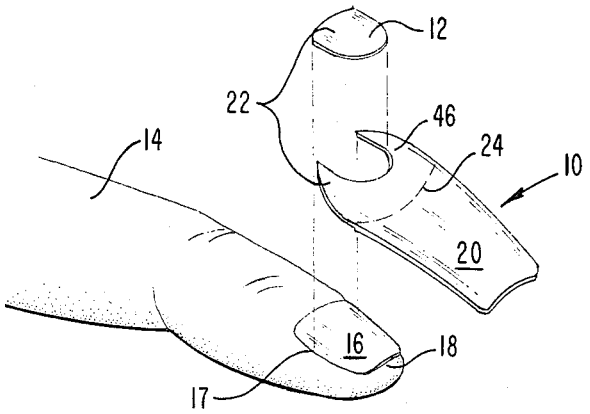
FIG. 1 is an exploded perspective view of the present invention positioned over a human nail plate.
Figure 2B:
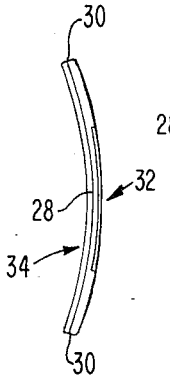
FIG. 2B is a rear end view of the artificial nail tip of FIG. 2A.
Figure 2A:
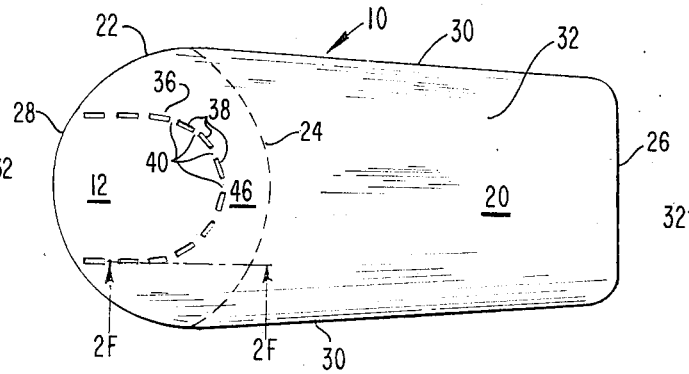
FIG. 2A is a top plan view of the preferred embodiment of the present invention.
Figure 2C:
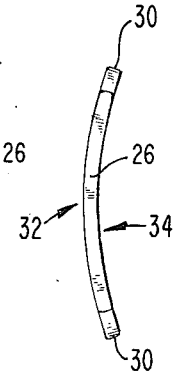
FIG. 2C is a front end view of the artificial nail tip of FIG. 2A.
Figure 2D:
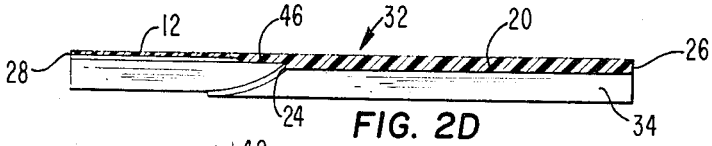
FIG. 2D is a side cross-sectional view of the artificial nail tip of FIG. 2A.
Figure 2E:
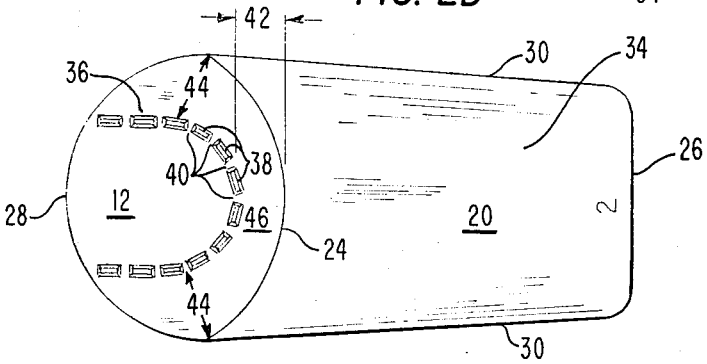
FIG. 2E is a bottom plan view of the artificial nail of FIG. 2A.
Figure 2F:
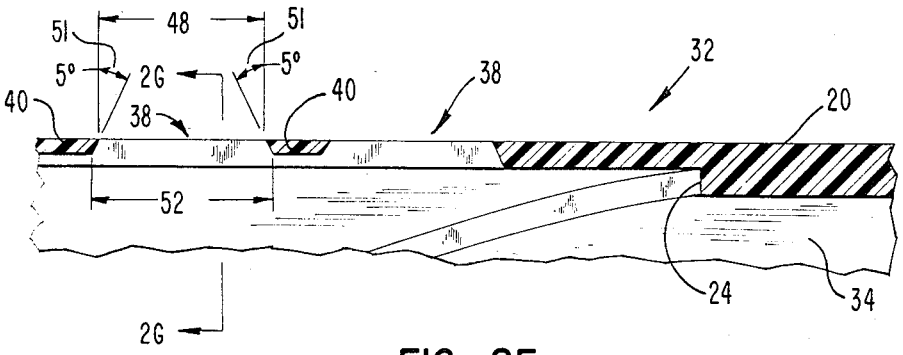
FIG. 2F is a detail cross-sectional view of the artificial nail of FIG. 2A shown from perspective 2F—2F.
Figure 2G:
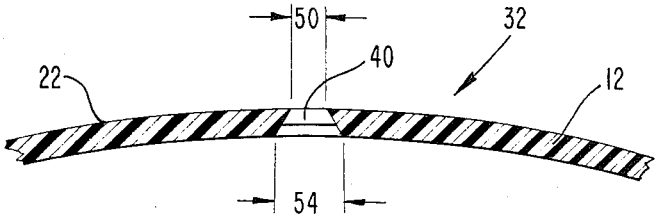
FIG. 2G is a detail cross-sectional view of the nail tip illustrated in FIG. 2F as shown from perspective 2G—2G.

An artificial nail tip 10 according to the preferred embodiment of the invention is illustrated in FIG. 1. A snap-off portion 12 can be removed from the rear section 22 so that the nail tip can accommodate hard to fit problem nails as will be more fully discussed with reference to FIGS. 4A–4F and 5A–5F. A typical human finger 14 includes a nail plate 16 having edge grooves 17 and a sole or hyponychium 18. Artificial nail tip 10 can be used in two modes. When used with normal, non-problem nail plates, the snap-off section 12 is left in place. When used in the first mode the artificial nail tip 10 functions identically to conventional prior art nail tips and therefore no further description of the first mode is necessary. However, if problem nail plates 16 are encountered such as described in FIGS. 4A–4F and 5A–5F, then the snap-off section 12 is removed and the nail tip 10 secured to the nail plate 16 by remaining rear portion 46. This is the second mode of use of the artificial nail tip 10. In either mode the hyponychium 18 comes up to the ledge boundary 24 between the front section 20 and rear section 22 of the nail tip 10.

The detailed structure of the artificial nail tip 10 according to the preferred embodiment of the invention is best understood by referring to FIGS. 2A–2G. Artificial nail 10 includes a thick front or forward section 20 and a thinner rear section 22 separated from front section 20 by a ledge or boundary line 24. Artificial nail tip 10 is preferably molded from ABS plastic, but could also be molded from Nylon® and Acetate. Scented plastic materials can also be used. The nature of the ABS plastic material is entirely conventional and does not comprise a part of the invention. However, it is important that the plastic material be moderately flexible so that the nail tip 10 can be flattened out when the snap-off section 12 is removed so that it can fit on problem nails such as the flat nail 72 illustrated in FIG. 5B. The rear section 22 of artificial nail tip 10 includes the removable snap-off portion 12 and the remainder section 46. Remainder section 46 has a skewed approximately hour-glass like shape with a relatively narrow waist 42 having dimensions in the range of 0.032" and 0.150" and a relatively wider top and bottom portion 44 having a width in the range of 0.098" and 0.187". The shape of remainder section 46 and the range of dimensions 42 and 44 varies proportionally with the size of the nail. The preferred thickness of the front section 20 is 0.015" and preferably falls within the range of 0.012" and 0.020". Likewise the preferred thickness of the rear section 22 is 0.005" and preferably falls within the range of 0.025" and 0.0010". Each artificial nail tip 10 also includes a front edge 26, a rear edge 28, a pair of side edges 30, a top surface 32 and a bottom surface 34.

Removable snap-off section 12 is separable from the remainder 46 of the rear portion 22 by a perforation line 36. Perforation line 36 comprises a plurality of apertures or perforations 38 separated by weakened zones 40 having a thickness that it thinner than the other portions of the rear section 22. Each weakened zone 40 preferably has a thickness in the neighborhood of 0.003" and a preferable range of thicknesses of 0.025" to 0.010". Perforation line 36 defines the geometry of the snap-off section 12 and the remainder section 46. Snap-off section 12 preferably has a wide mouthed U-shape thereby causing the remainder section 46 to have a generally skewed hour-glass shape with a relatively thin waist 42 and a relatively thicker land area at each end having a thickness 44 as previously described. It is relatively important that the waist 42 of remainder 46 be fairly narrow for reasons that follow. First, the larger the snap-off section 12, the relatively more flexible the nail tip 10 becomes. This permits the nail tip 10 to be more readily flattened to fit the contour of problem nail plates such as the flat nail 72 illustrated in FIG. 5B. Second, and perhaps more significantly, it is important to remove as much of the center section of the nail tip 10 as possible so as to avoid trying to make poor adhesive contact with the more difficult center portion of a problem nail plate 16. This feature will be better understood with reference to the discussion of FIGS. 4A–4F and 5A–5F that appears towards the end of this disclosure. Conversely, it is important that both ends of the remainder 46 be relatively wide. That permits the remainder 46 to have as large a land area as possible to attach itself to the edges of a nail plate 16 near nail grooves 17.

The number of apertures 38 in perforation line 36 can vary from as few as two apertures 38 for a small nail tip up to as many as 12 apertures 38 for a large nail tip. Therefore, the center to center distance between apertures 38 will vary according to the number of apertures 38 in that particular artificial nail tip 10. Each aperture 38 preferably has a truncated pyrimidal profile as shown in detail in FIGS. 2F and 2G. On the top surface 32 each aperture 38 has a preferred top long dimension 48 of 0.055" which falls within a preferred range of 0.052" to 0.093" and a preferred short dimension 50 which falls within a preferred 0.020 range of 0.019" to 0.032". Similarly on the bottom surface 34 each aperture 38 has a preferred long dimension 52 within a preferred range of 0.052" to 0.093" and a preferred short dimension 54 within a preferred range of 0.019" to 0.032". Since each aperture 38 has a rectangular opening and sloping sides, it therefore follows that the upper long dimension 48 is shorter than the bottom long dimension 52 and that the upper short dimension 50 is shorter than the bottom short dimension 54. The rectangular opening of aperture 38 on the top surface 32 preferably has a size in the neighborhood of 0.052 to 0.093 square inches. The draft angle of slope 51 of the sidewall is approximately 5° from the perpendicular of the plane of either top surface 32 or bottom surface 34.

It is desirable that the perforation line 38 permit the snap-off section 12 to be readily removed using the natural upward motion of the human hand alone and without the necessity of other implements such as scissors and the like. The tapered profile of the apertures 38 encourages users to snap-off section 12 in such a manner as to leave fewer dogged edges and in such a way as to avoid fault lines which could change the rest of the tip 10. However, it is also important that if the snap-off section 12 is not removed, that the rear portion 22 have sufficient integrity to adequately be attachable to a normal nail plate 16. When the snap-off section 12 is removed from the rear section 22 the remaining land area 46 is normally between one-third to two-thirds the area of the total original rear section 22 before the snap-out section 12 is removed. The weakened zone 40 between apertures 38 preferably has thicknesses in the range of 0.0025" to 0.0010" with a preferable thickness of 0.003".

The steps in the method of attaching the nail tip 10 to a problem nail plate 16 when the tip 10 is used in the second mode are illustrated in sequence in FIGS. 3A–3D. On a typical pair of human hands an individual might have seven normal nail plates and 3 non-normal i.e. problem nail plates 16. With regard to the seven normal nail plates, the user places the artificial tip 10 on those nail plates in the conventional manner. However, with regard to the three remaining problem nail plates 16, the user 10 takes advantage of the unique characteristics of the artificial nail tip 10 according to the preferred embodiment of this invention.

Figure 3A:
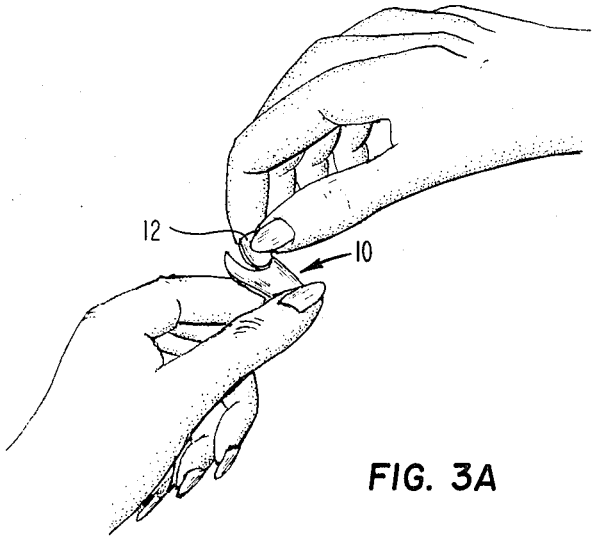
FIGS. 3A, 3B, 3C and 3D respectively show the steps necessary for attaching the artificial nail tip according to the preferred embodiment of the present invention to a problem nail plate.

In order to attach the artificial nail tip 10 to a problem nail plate 16 the user first removes the snap-off sections 12 from the artificial nail tip 10 in the manner illustrated in FIG. 3A. This is the first step. Normally the snap-off section 12 can be removed with minimal upward manual pressure. The use of shears or nippers or scissors is not necessary or desirable since they may damage the rest of the tip 10.

Figure 3B:
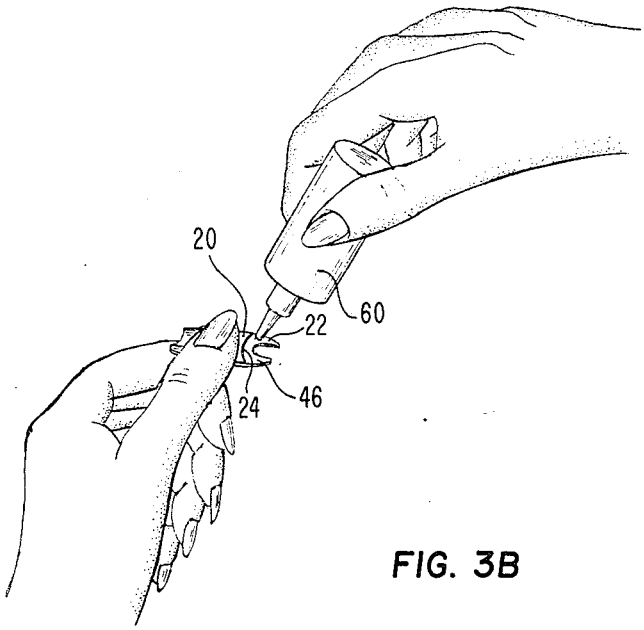

Second, the user places common nail glue or adhesive from a conventional dispenser 60 on the bottom surface 34 of remainder 46 of the rear portion 22 of the artificial nail tip 10. This second step is illustrated in FIG. 3B.

Figure 3C:
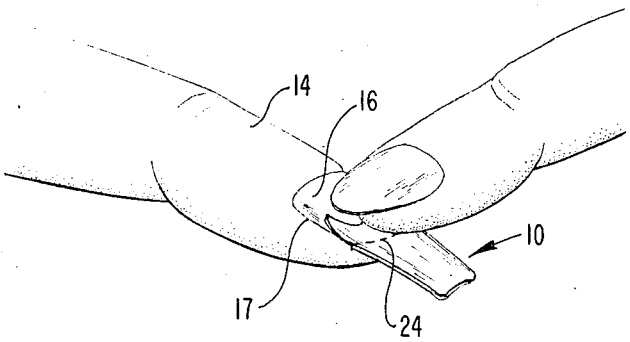
Figure 5A:
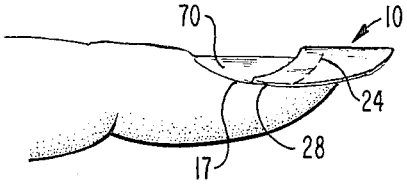
FIGS. 5A–5F illustrate how the two mode artificial nail tip according to the preferred embodiment of the present invention attaches readily to a bitten nail, a flat nail, a claw nail, a nail having deep grooves or high ridges, an olive pit nail and a ski nail respectively.
Figure 5B:
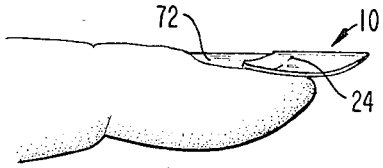
Figure 5C:
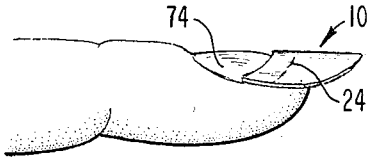
Figure 5D:
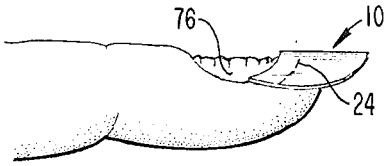
Figure 5E:
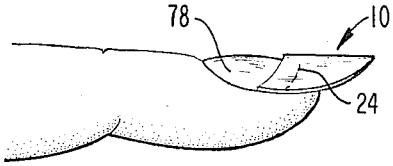

The third step, illustrated in FIG. 3C, is to attach the bottom surface 34 of the remainder 46 to the nail plate 16. The remaining rear edge 28 of the remainder portion 46 should fit into the nail grooves 17 of the nail plate 16. It may also be important for the user to push down on the artificial tip 10 to flatten it somewhat so that it better fits on certain types of problem nail plates such as relatively flat nail plates 72 as illustrated in FIG. 5B or to round it to fit on olive pit nails 78 as shown in FIG. 5E. Normally the artificial tip 10 is positioned such that the boundary ledge 24 comes up to the natural front edge of the nail plate 16 with the hyponycium extending beyond.

Figure 3D:
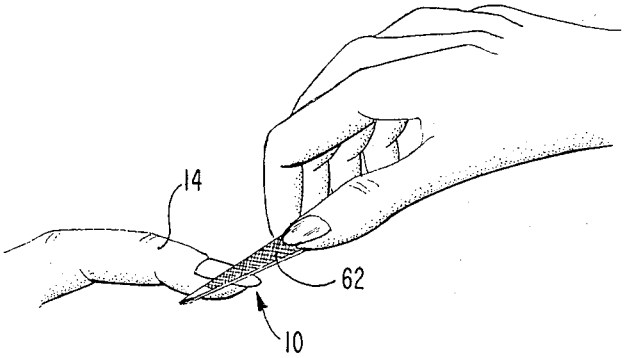

The fourth and last step is illustrated in FIG. 3D. After the adhesive has set, a conventional nail file 62 is employed to dress and finish the nail tip 10 so that it looks like all of the other finished nail tips. Conventional wraps, acrylics, fillers, liquids and the like can be applied to assist in the finishing process.

There are a wide variety of problem nail plates 16 for which the artificial nail tip 10 according to the preferred embodiment of the invention is especially suitable. There are many problems associated with trying to place conventional artificial nail tips on problem nail plates 16 as shown in FIGS. 4A–4E. First, artificial nail tips do not adhere well to problem nail plates 16. Often air pockets are formed and the resulting adhesive bond is relatively weak. This may cause the nail tip to separate prematurely. Second, it frequently happens that fungus will grow in the air pockets in the gap 66 between a conventional nail tip 64 and the underlying nail plate 16. The fungus can cause infection and occasionally seriously damage the health of the user. Third, in order to compensate for problem nails, it has been the practice of manicurists to carry a wide variety of artificial tips in order to deal with each individual problem nail. However it has been found, that the number of tips can be dramatically reduced by using a two mode artificial nail tip 10 as described in the present invention which may be employed for either normal nail plates or problem nail plates.

Figure 4A:
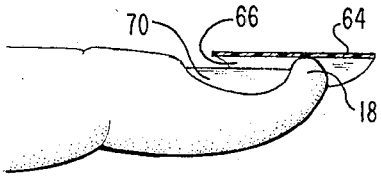
FIGS. 4A–4F illustrate a conventional prior art artificial nail positioned over a severely bitten nail, a flat nail, a claw nail, a nail having excessively deep grooves or high ridges, an olive pit nail and a ski nail respectively.

FIG. 4A illustrates an attempt to place a conventional artificial nail tip 64 on the nail plate 70 of a nail biter. Note the exaggerated size of the hyponychium 18 which creates a large air gap 66 between the artificial nail tip 64 and the nail plate 70. Such a large air gap will frequently cause the artificial tip 64 to separate from the nail plate 70. The problem is solved as shown in FIG. 5A by use of the present invention 10 with the snap-off portion 12 removed so that the artificial tip 10 adequately anchors to the nail plate 70. The characteristics of a bitten nail are that the nail plates 70 are generally very flat and the hyponychium 18 is often swollen. Accordingly, there is frequently not enough nail plate 70 to adequately support a conventional artificial tip 64. A major advantage of the present invention 10 is that when the snap-off section 12 is removed, it can be flattened so that the rear edge 28 reaches securely into the nail grooves 17. In this manner the nail tip 10 decreases the air gap 66 since it is flatter and further improves the adhesion characteristics since it is attachable to a greater portion of the nail plate 16.

Figure 4B:
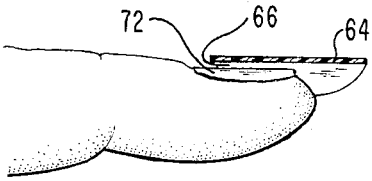

Flat nails 72 such as shown in FIG. 4B are similar to bitten nails 70 such as shown in FIG. 4A except that the hyponychium 18 is usually not swollen. Because conventional nail tips 64 are normally curved and flat nails 72 are normally flat, there is an air gap 66 that naturally forms between the nail plates 72 and the artificial tip 64. This problem can be remedied by removing the snap-off section 12 and flattening the nail tip 10 as shown in FIG. 5B so that it fits more snugly from nail groove 17 to nail groove 17.

Figure 4C:
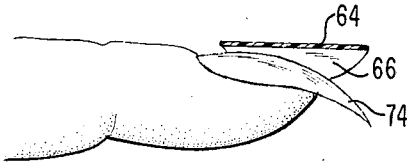

Claw nails 74 such as illustrated in FIG. 4C are characterized by their apparent thickness and their tendency to break at stress points near the hyponychium 18. Because of the downward diversion of the claw nail 74 a gap 66 normally occurs between a conventional nail 64 and the nail plate 74. If an artificial nail tip 10 according to the present invention is used as shown in FIG. 5C, it is possible to minimize the size of the gap 66 because the artificial nail tip 10 normally rides lower than the conventional tip 64 illustrated in FIG. 4C. The preferred approach then is to file back the natural claw nail plate 74 so that as the nail plate 74 grows back (normally at about $\frac{1}{8}''$ per month). There will be gradual reinforcement at the stress point and the gap 66 will be substantially minimized if not completely eradicated.

Figure 4D:
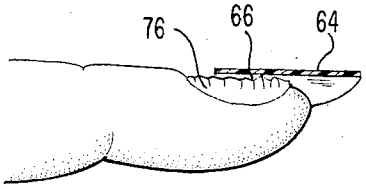

Almost all human beings have grooves and ridges in their nail plates 16. Occasionally the grooves and ridges become so pronounced that they make it difficult for a conventional nail tip 64 to make a secure adhesive attachment. FIG. 4D shows a problem nail 76 having high ridges and deep grooves therein. When a conventional artificial plastic tip 64 is attached to a heavily grooved and ridged nail 76 it forms air pockets 66 therein which trap moisture and provide a site for potential fungus infection. FIG. 5D illustrates the application of the artificial tip according to the present invention to a problem nail 76. The advantage of using the artificial tip 10 according to the present invention is that less filing is required on the natural tip 76 and the tip adheres better to the nail 76 since there is less abnormal surface to be correctly fitted—thereby minimizing or eliminating air pockets 66.

Figure 4E:
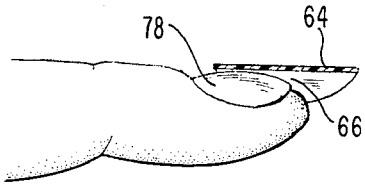

An olive pit type nail plate 76 is illustrated in FIG. 4E. The olive pit nail plate 78 is characterized by a domed top having extreme curvature in both directions. It is virtually impossible to correctly fit a conventional plastic tip 64 to an olive pit nail plate 78 without having a significant gap 66 form. However, an improved fit can be obtained with the artificial nail tip 10 according to the preferred embodiment of the present invention if the snap-off section 12 is removed. The remaining section 46 can thereby be molded more efficiently and effectively to the general shape of the olive pit nail plate 78 as shown in FIG. 5E.

Figure 4F:
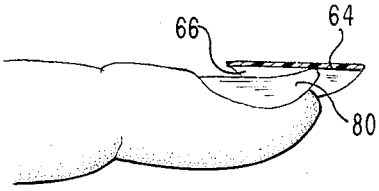
Figure 5F:
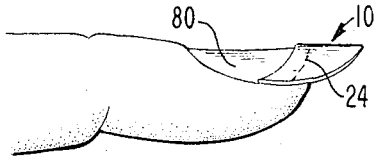

A ski nail 80 is illustrated in FIG. 4F. It is difficult to attach a conventional nail tip 64 to a ski nail plate 80 because of the air gap 66 that forms between the front tip of the nail plate 80 and the rest of the nail plate 80. This problem can be largely solved by employing the artificial nail tip 10 according to the preferred embodiment of the present invention with the snap-out section 12 removed. The front edge of the ski tip nail plate 80 is preferably filed down so that the remaining portion 46 adheres better to the nail plate 80. As the nail plate 80 continues to grow the weight of the tip 10 will correct the natural upward growth tendency of the nail plate 80.

The foregoing illustrates only six (6) of the major types of problem nails that the present invention 10 addresses. There are other types of problem nails that the present invention 10 will also work well on.

It is clear from the foregoing that the present invention offers major advantages over conventional prior art plastic nail tips 64. First of all, the invention decreases the number of nail tips that a beautician or manicurist has to carry since one type of nail tip 10 will work well in a wider variety of different situations. Second, because the artificial nail tip 10 with the snap-off section 12 removed attaches more firmly to problem nails, it therefore follows that there are fewer involuntary and embarrassing nail tip separations. Third, and perhaps most importantly, the artificial nail tip 10 with the snap-off section 12 removed produces fewer air pockets where moisture can accumulate and fungus can grow. Infection brought on by fungus growth can have serious medical consequences. This problem is substantially minimized by use of the present invention.

While the invention has been described with reference to the preferred embodiment thereof it will be appreciated by those of ordinary skill in the art that various changes can be made to the structure and parts of the invention without departing from the spirit and scope of the invention as a whole.

I claim:

1. An artificial nail tip apparatus having a top side and a bottom side for attachment to a human finger having a nail plate with a forward edge, said apparatus comprising:

a forward section which normally extends beyond the forward edge of said nail plate when attached to said nail plate;

a rear section attachable to said nail plate and connected to said forward section along a boundary, said rear section having an average cross-sectional profile which is thinner than the average cross-sectional profile of said forward section; and portion removing means incorporated in said rear section for separating a removable portion of said rear section from said rear section, said portion removing means comprising a series of apertures arranged in a line so that said removable portion can be snapper off, wherein removal of said removable portion permits said rear section to attached more securely nail plates.

2. The apparatus of claim 1 wherein the remaining portion of said rear section left after said removable portion is removed has a shape that is relatively thin in the center and relatively wider near its end, wherein the artificial nail tip apparatus is weakened after removal of said removable portion so that said nail tip apparatus is more easily flattened after removal.

3. The apparatus of claim 2 wherein the space between said apertures is weakened relative to the rest of said rear section forming a plurality of weakened zones to enhance the ability to snap-off said removable portion.

4. The apparatus of claim 3 wherein said apertures are longer than they are wide.

5. The apparatus of claim 4 wherein said apertures have a length in the range of 0.052" to 0.093" and a width in the range of 0.019" to 0.032" on the top side of said nail tip apparatus and a length in the range of 0.052" to 0.093" and a width of 0.019" to 0.093 "on the bottom side of said nail tip apparatus and the angle of inclination of the side wall between the apertures on the top side and the apertures on the bottom side is approximately 5° from the perpendicular of the plane of the top surface.

6. The apparatus of claim 5 wherein said apertures have a preferred width of 0.020" and a preferred length of 0.055" on the top side of said nail tip apparatus and a preferred width of 0.020" and preferred length of 0.055" on the bottom side of said nail tip apparatus.

7. The apparatus of claim 6 wherein said weakened zones between said apertures has a preferred thickness in the range of 0.0025" to 0.004".

8. The apparatus of claim 7 wherein said weakened zone between said apertures has a preferred thickness of 0.003".

9. The apparatus of claim 8 wherein said artificial nail tip is formed from a ABS plastic.

10. The apparatus of claim 9 wherein said apertures have a cross-sectional profile approximately in the shape of a truncated pyramid and are smaller on said top side than on said bottom side.

11. A method for attaching an artificial nail tip to a human nail plate having a forward edge, said artificial nail tip including a forward section which normally extends beyond the forward edge of said nail plate and a rear section attachable by adhesive to said nail plate and connected to said forward section along a boundary locatable approximately above the front edge of said nail plate, said rear section also including a snap-off removable portion said method comprising the steps of:

snapping off said removable portion of said rear section;

applying adhesive to the interface between the remaining portion of said rear section and said nail plate; and, bringing said remaining portion of said rear section into contact with said nail plate so that adhesive attachment is achieved.

* * * * *